United States Patent [19]

Hilton

[11] 4,017,070

[45] Apr. 12, 1977

[54] TRAINING DEVICE FOR POLE VAULTERS

[76] Inventor: H. Ronald Hilton, 7 Morningside Drive, Pennington, N.J. 08534

[22] Filed: Sept. 29, 1975

[21] Appl. No.: 617,622

[52] U.S. Cl. ..... 272/104; 35/129 R; 273/67 R

[51] Int. Cl.[2] ..... A63B 5/06

[58] Field of Search ..... 272/101, 104; 273/183 D, 26 B, 165, 81.2, 81 D, 188 R, 25, 72 R, 193 R, 194 R, 67 R; 35/29 R, 29 A

[56] References Cited

UNITED STATES PATENTS

| | | | |
|---|---|---|---|
| 748,000 | 12/1903 | Murnave | 273/72 R |
| 2,091,458 | 8/1937 | Sleight | 273/72 R |
| 3,244,421 | 4/1966 | Hanna | 35/29 A X |
| 3,469,839 | 9/1969 | Pietronuto et al. | 273/72 R X |
| 3,521,883 | 7/1970 | Hamilton | 273/26 B |
| 3,740,085 | 6/1973 | Evans | 273/81.2 X |

FOREIGN PATENTS OR APPLICATIONS

| | | | |
|---|---|---|---|
| 17,135 | 12/1929 | Australia | 275/165 |

*Primary Examiner*—Jerome Schnall
*Attorney, Agent, or Firm*—Sperry and Zoda

[57] ABSTRACT

A device intended primarily for removable connection to a vaulting pole as an aid in training athletes in the proper techniques of pole vaulting is adjusted longitudinally on a vaulting pole to a selected location in the area in which the vaulting pole would be grasped by the athlete. When the device has been properly positioned, it is secured fixedly, in the selected location, defining abutments spaced longitudinally of the vaulting pole to deter the user from sliding his hands together out of their proper, hands-apart relationship. The device is also adapted to be extended adjustably to a selected length so as to predetermine, in an adjustable manner, the longitudinal spacing of the abutments defined by the opposite extremities of the training device, thus to accommodate the device to the physical characteristics of the particular user. Calibrations are utilized on the device, so as to facilitate in a determination as to the most effective spacing of the abutments or extremities thereof.

6 Claims, 5 Drawing Figures

TRAINING DEVICE FOR POLE VAULTERS

BACKGROUND OF THE INVENTION

1. Field of the Invention

The invention relates primarily to the field of training devices for athletes. In a more specific sense, the device is intended for use in the training of pole vaulters, and is a removable attachment, connectable to a conventional vaulting pole so as to be classifiable, appropriately, as an exercising or training device designed particularly for use in field sports and even more specifically in the pole vaulting category or field sport event.

2. Description of the Prior Art

It has been heretofore proposed, generally, to provide training devices for use in field sports to aid in the development in proper techniques. Thus, in javelin throwing, it has been proposed to provide a training javelin such as in U.S. Pat. No. 3,746,334, in which collarlike attachments are provided on a javelin. Such attachments, however, are primarily concerned with permitting indoor exercising or training programs, and in no sense has there been any suggestion, so far as is known, for an attachment intended specifically for use on a vaulting pole, for the purpose of training athletes in the proper hands-apart techniques.

Attachments for vaulting poles heretofore devised have been for purposes other than that for which the present invention is primarily intended, and naturally enough, have failed to show any real capability of discharging the intended purpose of the present invention. For example, a collarlike attachment has been illustrated for a vaulting pole in U.S. Pat. No. 3,815,902, but this has been for measuring purposes, and would be incapable of use as a training device for pole vaulters intended to train one specifically in a proper hands-apart technique.

In U.S. Pat. No. 3,012,778, it has been suggested that a socket be provided for the lower end of a vaulting pole for training purposes. However, again there has been no suggestion for a training device having the specific purpose, manner of use, and physical locating and adjustability characteristics inherent in and indeed specifically designed into the present invention.

The problem, it may be noted, has to do primarily with novice vaulters, although the problem may indeed exist in the training of pole vaulters who are more advanced. For example, in high school athletic training programs, considerable effort has been expended in recent years to expand such programs in the direction of field sports, including pole vaulting. The modern vaulting pole is a fiberglass pole as compared to bamboo and steel poles of earlier eras. In the earlier poles, the bending characteristics of the pole, that is, the basic flexibility and resiliency thereof, was more limited than is true of the modern, fiberglass pole. As a result, the approved technique was one in which the hands were placed together on the pole.

The hands-together technique was found to be a detrimental factor in the training of athletes in the use of the modern, fiberglass poles, since the capability of the athlete is related directly to a bending moment of the pole, achieved through a particular combination of speed, drive off the takeoff foot, and very importantly, a wide-spaced, so-called hands-apart, grip upon the pole.

Novice vaulters, in particular, are prone to slide their hands together, so that much is taken away from their capability of vaulting with a proper technique. This is a problem that has been encountered by those who train athletes at high school or for that matter at college level and is the problem to which the present invention addresses itself.

SUMMARY OF THE INVENTION

Summarized briefly, the present invention is, in one preferred embodiment, in the form of a pair of collars, axially bored for the purpose of permitting them to be slid onto or off of a vaulting pole. Each collar is provided with a plurality of elongated members extending in closely spaced, parallel relation to the vaulting pole in the direction of the other collar, so as to be slidably, telescopically related to complementary or mating members provided upon said other collar. The telescopically related members are calibrated in inches or fractions thereof, or in any other selected system of measurement. Thus, the entire device can be slid onto a vaulting pole as a complete assembly, can be located at a selected location along the length of the pole, and thereafter, can be further adjusted as to the distance between the opposite extremities of the device, the calibrations aiding in this last adjustment, after which the device is swiftly locked to the pole at the selected location along the length of the pole and in the selected, spaced relationship between the collars or extremities of the device. The user is thus required to grasp the pole beyond the opposite extremities, thus deterring and indeed positively preventing the athlete from placing his hands improperly.

DESCRIPTION OF THE PREFERRED EMBODIMENTS

Figure 1:
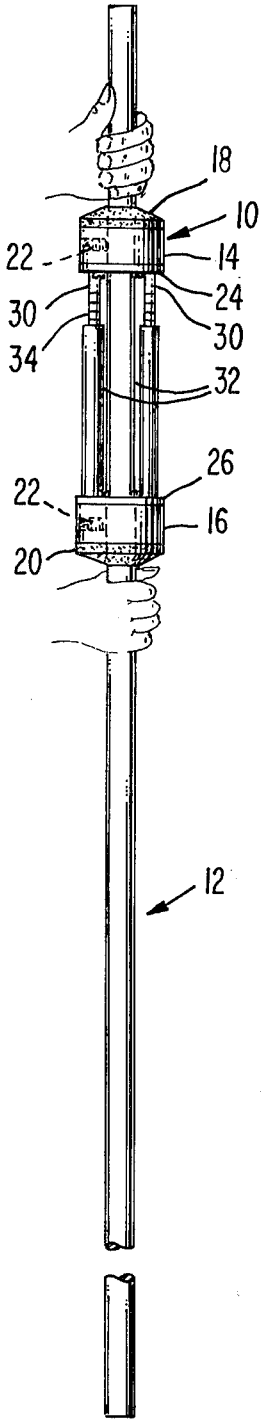
FIG. 1 is an elevational view of a vaulting pole, portions being broken away, with a device according to the present invention attached thereto in a use position.
Figure 2:
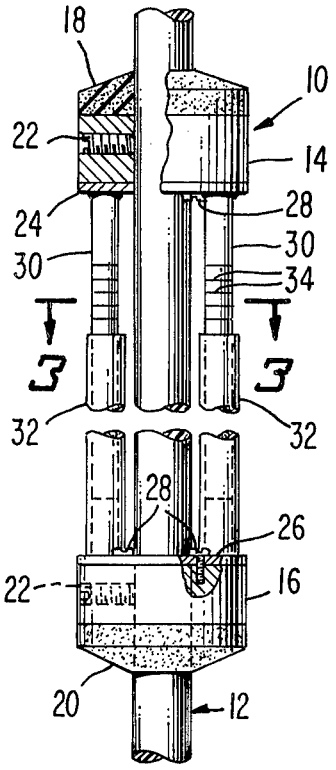
FIG. 2 is an enlarged view of the device, partly in side elevation and partly in section, portions of said device and of the pole being broken away.
Figure 3:
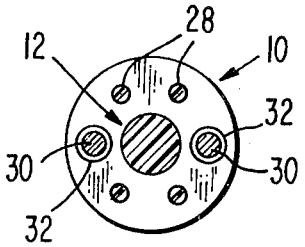
FIG. 3 is a transverse sectional view substantially on line 3—3 of FIG. 2.

Referring to the drawing in detail, the reference numeral 10 generally designates, in FIGS. 1—3, a training device for pole vaulters, constructed in accordance with the present invention, as it appears when applied to a conventional fiberglass vaulting pole generally designated 12. In FIGS. 1—3, the invention may be broadly considered as a means removably attachable to a vaulting pole, in the area in which the pole is grasped by a user, and that is adapted to be fixedly secured in any selected position in said area. It may further be noted that when the general area of mounting of the device has been selected, the device may then be extended or contracted longitudinally of the vaulting pole, so that the overall length of the device can be predetermined and established by the instructor. Then, the device is swiftly clampable or otherwise capable of fixed connection to the vaulting pole, so as to not only become rigidly attached to the pole in the selected area, but also to be at the same time, fixed in respect to its selected, adjusted, overall length.

In carrying out these functions or purposes, I provide a training device 10 which in FIGS. 1–3 includes upper and lower, opposite but identical collars 14, 16 respectively. Collars 14, 16 can be formed of a lightweight metal, wood, plastic, or any other suitable material, and in the illustrated embodiment, the collars are in the form of relatively large diameter members, the opposite faces of which are flattened, with an axial bore extending through each collar to provide a snug sliding fit of the collar upon the pole 12.

Each collar, thus, may be considered as having an outer face defined by the surface of the collar that faces away from the opposed, cooperating collar. Adhesively or otherwise secured to the outer faces of the collars 14, 16 are soft, resilient pads or cushions 18, 20 respectively. In the illustrated embodiment, these are of foam rubber but it will be understood that the materials selected can be varied. It is mainly important that the pads provide surfaces that may be comfortably engaged by the hands of the user, in the manner shown in FIG. 1.

The collars, when slidably positioned upon the vaulting pole 12, are adapted to be fixedly secured to the pole in selected positions of slidable adjustment, through the medium of set screws 22, threadedly engaged in radial bores of the collars that are in communication with the axial bores thereof. Thus, the set screws are adapted to be threaded inwardly into contact with the vaulting pole, in such fashion as to fixedly attach the respective collars to the vaulting pole in the selected positions of adjustment of the collars.

To the inner faces of the respective collars there are secured flat, metal rings 24, 26, said rings being secured to the collars through the medium of screws 28 or equivalent fastening elements. The rings, collars, and end cushions are all of the same outer diameter as shown to best advantage in FIG. 2, and thus, each collar and the foam rubber pad and rings secured thereto defines an end abutment on the training device, such that the hand of the user will be adapted to grasp the pole at any location beyond said abutment, the normal practice being to position the hand directly against the abutment whereby the hands will be spaced apart in the manner shown in FIG. 1 to the extent necessary to assure proper pole vaulting technique.

In the embodiment shown in FIGS. 1–3, secured to the ring 24 is a pair of diametrically opposed rods 30, extending in closely spaced, parallel relation to the pole 12, the spacing of the rods from the pole being such as to prevent the user from grasping the pole in the area within which the pole is coextensive with said rods. Rods 30, at their distal ends, are slidably telescoped in tubular rods or sleeves 32, the proximal ends of which are fixedly secured to the ring 26 attached to collar 16.

By reason of this arrangement, the rods 30, 32 cooperate in defining adjustably extensible elements that extend the full distance between the abutments defined by the cushioned collars, in such fashion as to prevent the user from grasping the pole 12 in the area between the collars.

In order to determine the extent to which the collars are spaced apart, I provide calibrations 34, which may be marked in inches, fractions of inches or in any other way found desirable. These calibrations are individually adapted to register with the distal ends of the sleeves 32. In this way, the instructor can slide the entire assembly onto the pole 12, with the set screws 22 backed out to permit the device to be mounted on the pole. The general area in which the device is to be attached to the pole can then be selected, after which, according to the physical characteristics of the athlete being trained, the distance between the abutments can be selected by registration of a suitable calibration 34 with the adjacent end of sleeve 32. Then, the set screws 32 are turned home, the entire device is now fixedly secured to the pole in the selected position of adjustment, it being apparent that two adjustments are provided and are preserved by engagement of the set screws against the pole. The first adjustment, of course, is the bodily adjustment of the entire device along the length of the vaulting pole. The second adjustment is the adjustment of the device itself as to length. That is, the first or main adjustment selects the area in which the hands are to be placed, and the second adjustment determines the distance that the hands are to be kept apart in the selected area.

Figure 4:
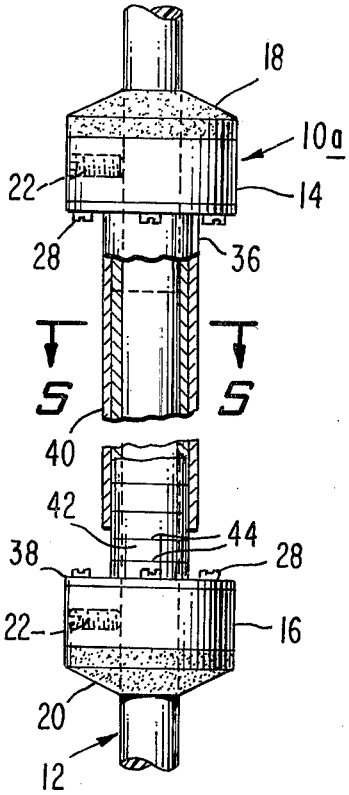
FIG. 4 is a view similar to FIG. 2 showing a modified construction.
Figure 5:
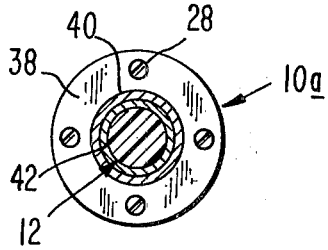
FIG. 5 is a transverse sectional view substantially on line 5—5 of FIG. 4.

Referring now to FIGS. 4 and 5, in this form of the invention the collars 14 and the foam rubber pads are identical to those used in the first form. In this form, there are provided rings 36, 38 which are similar to the rings 24, 26, except that these rings are not attached to parallel rods or sleeves. Rather, integral or otherwise permanently, fixedly attached to ring 36 is an elongated sleeve 40, concentric with the ring and with the vaulting pole, and slidably, telescopically receiving a sleeve 42 integral or otherwise rigid with the ring 38. Ring 42 is slidably, snugly engaged with the vaulting pole 12.

Calibrations 44 are provided upon the sleeve 42, and are adapted to be individually registrable with the distal extremity of sleeve 40. Thus, as in the first form of the invention, the entire device may be bodily slipped onto the vaulting pole 12. Then, also as in the first form of the invention, the general area in which the device is to be mounted may be selected according to the desires of the instructor. Finally, the distance that the collars are to be spaced apart is adjusted, to assure that the trainee's hands are positioned upon the pole no closer than is considered proper for the particular characteristics, in the physical sense, of that trainee. Finally, screws 22 are threaded against the pole 12 similarly to the screws in the first embodiment of the invention. As in the first form, the device prevents grasping of the pole itself in the area between the abutments defined by the cushioned collars.

In use of a training device according to the present invention, the desirable result is obtained of preventing the novice vaulter, or for that matter, a vaulter who is in a somewhat more advanced stage of training or development, from improperly grasping the pole. There has been a great tendency, it has been observed, for the vaulting novice to slide his hands together as he swings up on the pole and extends his body over the crossbar. This was, indeed, the approved vaulting technique during the bamboo and steel pole era of this event. Since the coming of the fiberglass pole, however, this particular manner of grasping a pole has been found to have a detrimental effect upon the capability of the athlete to vault properly. This, it has been found, is due to the fact that the modern fiberglass pole has a bending or resiliency moment that is far different from that inherent in bamboo or steel poles of earlier days. The fiberglass pole bends to a far greater extent and the bending is achieved through a combination of speed, drive off the take-off foot, a bending of the vaulter's back, and a wide-spaced grip.

The invention as illustrated and described deters the novice vaulter from the hand slide. At the same time, it has the desirable characteristics of being radially attachable to or detachable from a completely conventional fiberglass pole swiftly and with ease. And, in attaching the device to the pole, the instructor swiftly adjusts the device bodily according to the particular physical characteristics of the trainee, and then with equal swiftness adjusts the overall length of the device, that is, the distance that the hands are to be spaced apart in the general area selected. Threading the set screws against the pole retains both adjustments, and the device is now ready for use.

The device has the further desirable characteristic in that not only does it eliminate the necessity of crude expedients designed to properly locate the hands, but also permits the same pole to be used by a number of vaulters. Heretofore, it was the practice, in many instances, to tape poles to prevent one's hands from slipping. Doing this, however, proved to be a benefit to only one vaulter. Fiberglass poles are selected according to the weight of the vaulter using the pole. When two vaulters use the same pole, as is often the case, the spacing of the tape for one has been found to be almost invariably wrong for another, due to differences in body size and hand grip. Still further, the spacing of the hands on the pole varies from one vaulter to another according to the ability, progress and courage of the particular trainees involved.

Vaulting poles vary in diameter, and accordingly, it may be desirable in some instances that the axial openings of the device be varied from one device to another. Alternatively, it may be desired to provide a device that is so designed that the collars would be hinged, that is, each collar would very possibly be comprised of semi-circular sections, hinged together so as to be capable of being opened, after which rubber inserts can be placed in the space between the semi-circular sections to adjust the same for different pole sizes, with a spring clamp or hook being used to secure the sections together in gripping relation to the vaulting pole.

The abstract of this application is not intended to constitute a comprehensive discussion of all the principles, possible modes or applications of the invention disclosed in this document, and should not be used to interpret the scope of the claims which appear hereinafter.

I claim:

1. The combination, with a vaulting pole, of a universal, quickly-adjustable device for training vaulters in sound vaulting techniques and in particular for properly locating the vaulter's hands upon said pole, said device comprising means extending longitudinally of the vaulting pole and formed to deter the vaulter from grasping the pole between the opposite extremities of said means, said means including a pair of collars slidably, removably mounted upon the pole, each collar including means for fixing the same to the pole against movement from a selected position to which the collar is slidably moved therealong, and adjustably extensible elements extending between the collars and carried thereby in positions to deter a user from grasping the pole in the area between the collars.

2. The combination of claim 1, wherein said adjustably extensible elements comprise at least one rod disposed exteriorly of and extending along said pole in the space between the collars, said rod being secured at one end to one of said collars, and a sleeve secured at one end to the other collar and also disposed exteriorly of and extending along said pole in the space between the collars, the other end of the sleeve being formed open and the other end of the rod being slidably telescoped in said other end of the sleeve.

3. The combination, with a vaulting pole, of a universal, quickly-adjustable device for training vaulters in sound vaulting techniques and in particular for properly locating the vaulter's hands upon said pole, said device comprising means extending longitudinally of the vaulting pole and formed to deter the vaulter from grasping the pole between the opposite extremities of said means, said means including a pair of collars each of which is adapted to be slidably mounted upon the pole, each collar including means for affixing the same to the pole in a selected position to which it is adjusted therealong; members extending from the respective collars and slidably telescoping in the area between the collars to deter a user from grasping the pole in the area between the collars; and calibrations on at least one of said members adapted to provide an indication as to the distance said collars are spaced apart upon the pole.

4. A vaulting pole attachment as in claim 3, further including resilient pads on said collars at the extremities of said means, adapted to be engaged by the hands of a vaulter grasping the pole.

5. A vaulting pole attachment as in claim 4 wherein said pads have tapered outer surfaces.

6. The combination, with a vaulting pole, of a universal, quickly-adjustable device for training vaulters in sound vaulting techniques and in particular for properly locating the vaulter's hands upon said pole, said device comprising:

a. a pair of opposite but identical, annular collars having center openings adapted for snugly, slidably mounting said collars upon a vaulting pole for adjustment longitudinally of the pole independently of each other to selected positions to which said collars are spaced apart along the length of the pole in an area of the pole to be grasped by a user;

b. resilient, circular pads secured to and covering said collars, exteriorly of the space between the collars, each pad and its associated collar cooperating to provide an abutment adapted to be engaged by the hand of a vaulter grasping the pole at a location beyond the space between the collars;

c. means on each collar for separably but fixedly attaching the same to the pole in the selected position to which the collar is adjusted along the length of the pole;

d. members on the respective collars extending longitudinally of the pole in the space between the collars, said members being slidably, telescopically engaged with each other, in an overlapped relationship in said space between the collars, said members being formed to prevent grasping of the pole by a vaulter at any location along the length of the pole occurring in the space between the collars; and e. calibrations on at least one of said members adapted to be registered with an extremity of another member, adapted to provide information for a user as to the total distance between the hands of a vaulter grasping a pole in contact with the pad of the respective collars.

* * * * *